US009871289B2

(12) United States Patent
Hsu et al.

(10) Patent No.: US 9,871,289 B2
(45) Date of Patent: Jan. 16, 2018

(54) ANTENNA STRUCTURE AND METHOD FOR MANUFACTURING THE SAME

(71) Applicant: Wistron NeWeb Corp., Hsinchu (TW)

(72) Inventors: Yuan-Chin Hsu, Hsinchu (TW); Tzu-Min Wu, Hsinchu (TW)

(73) Assignee: Wistron Neweb Corp., Hsinchu (TW)

( * ) Notice: Subject to any disclaimer, the term of this patent is extended or adjusted under 35 U.S.C. 154(b) by 232 days.

(21) Appl. No.: 14/931,104

(22) Filed: Nov. 3, 2015

(65) Prior Publication Data

US 2017/0054207 A1 Feb. 23, 2017

(30) Foreign Application Priority Data

Aug. 17, 2015 (TW) ..... 104126673 A

(51) Int. Cl.
*H01Q 1/38* (2006.01)

(52) U.S. Cl.
CPC ..... *H01Q 1/38* (2013.01)

(58) Field of Classification Search
CPC ..... H01Q 1/38; H01Q 1/385
USPC ..... 300/700 MS
See application file for complete search history.

(56) References Cited

U.S. PATENT DOCUMENTS 5,914,693 A * 6/1999 Takei ..... H01Q 13/16 343/700 MS
6,133,883 A * 10/2000 Munson ..... H01Q 1/38 343/700 MS
6,344,823 B1 * 2/2002 Deng ..... H01Q 9/0421 29/600
6,661,380 B1 * 12/2003 Bancroft ..... H01Q 1/243 343/700 MS
8,106,836 B2 * 1/2012 Hill ..... H01Q 1/243 343/700 MS
2011/0140977 A1 * 6/2011 Yang ..... H01Q 1/2216 343/725

* cited by examiner

*Primary Examiner* — Huedung Mancuso
(74) *Attorney, Agent, or Firm* — Muncy, Geissler, Olds & Lowe, P.C.

(57) ABSTRACT

An antenna structure is provided. The antenna structure includes a metal sheet including an antenna branch and a grounding structure, wherein the antenna branch and the grounding structure are formed in one piece from the metal sheet, wherein the metal sheet has a top surface and a bottom surface, and the top surface and the bottom surface are opposite each other; a conductive glue disposed over the bottom surface of the metal sheet; and a supporting material disposed over a bottom surface of the conductive glue, wherein the supporting material is disposed corresponding to the antenna branch of the metal sheet. A method for manufacturing the antenna structure is also provided.

18 Claims, 12 Drawing Sheets

ANTENNA STRUCTURE AND METHOD FOR MANUFACTURING THE SAME

CROSS REFERENCE TO RELATED APPLICATIONS

This application claims priority of Taiwan Patent Application No. 104126673, filed on Aug. 17, 2015, the entirety of which is incorporated by reference herein.

BACKGROUND

Technical Field

The disclosure relates to an antenna structure and a method for manufacturing the same, and in particular to an antenna structure having an antenna branch and a grounding structure and a method for manufacturing the same.

Description of the Related Art

With the progress of mobile communication technology, mobile devices, such as portable computers, mobile phones, multimedia players, and other hybrid functional portable electronic devices, have become more common. To satisfy user demand, portable electronic devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

In a mobile device, an antenna structure for wireless communication is an indispensable component. However, the existing antenna structures have not been satisfactory in every respect.

Therefore, cost-effective antenna structures and a method for manufacturing the same are needed.

SUMMARY

The present disclosure provides an antenna structure, including a metal sheet, a conductive glue, and a supporting material. The metal sheet includes an antenna branch and a grounding structure, wherein the antenna branch and the grounding structure are formed in one piece from the metal sheet. The metal sheet has a top surface and a bottom surface, and the top surface and the bottom surface are opposite each other. The conductive glue is disposed over the bottom surface of the metal sheet. The supporting material is disposed over the bottom surface of the conductive glue. The supporting material is disposed to correspond to the antenna branch of the metal sheet.

The present disclosure also provides a method for manufacturing an antenna structure, including providing a stack structure, performing a first cutting step, removing the release paper in the antenna branch-forming region, attaching a supporting material onto the exposed bottom surface of the conductive glue in the antenna branch-forming region, and performing a second cutting step. The stack structure includes a release paper, a conductive glue disposed over the top surface of the release paper, and a metal sheet disposed over the top surface of the conductive glue. The stack structure includes an antenna branch-forming region and a grounding structure-forming region. The first cutting step is to cut the metal sheet in the antenna branch-forming region to form an antenna branch. The release paper in the antenna branch-forming region is removed to expose the bottom surface of the conductive glue in the antenna branch-forming region, wherein the bottom surface and the top surface of the conductive glue are opposite each other. The second cutting step is to cut the metal sheet, the conductive glue, the release paper, and the supporting material to form a grounding structure in the grounding structure-forming region, wherein the antenna branch and the grounding structure are formed in one piece from the metal sheet.

A detailed description is given in the following embodiments with reference to the accompanying drawings.

BRIEF DESCRIPTION OF THE DRAWINGS

The disclosure may be more fully understood by reading the subsequent detailed description and examples with references made to the accompanying drawings, wherein.

DETAILED DESCRIPTION

Figure 1A:
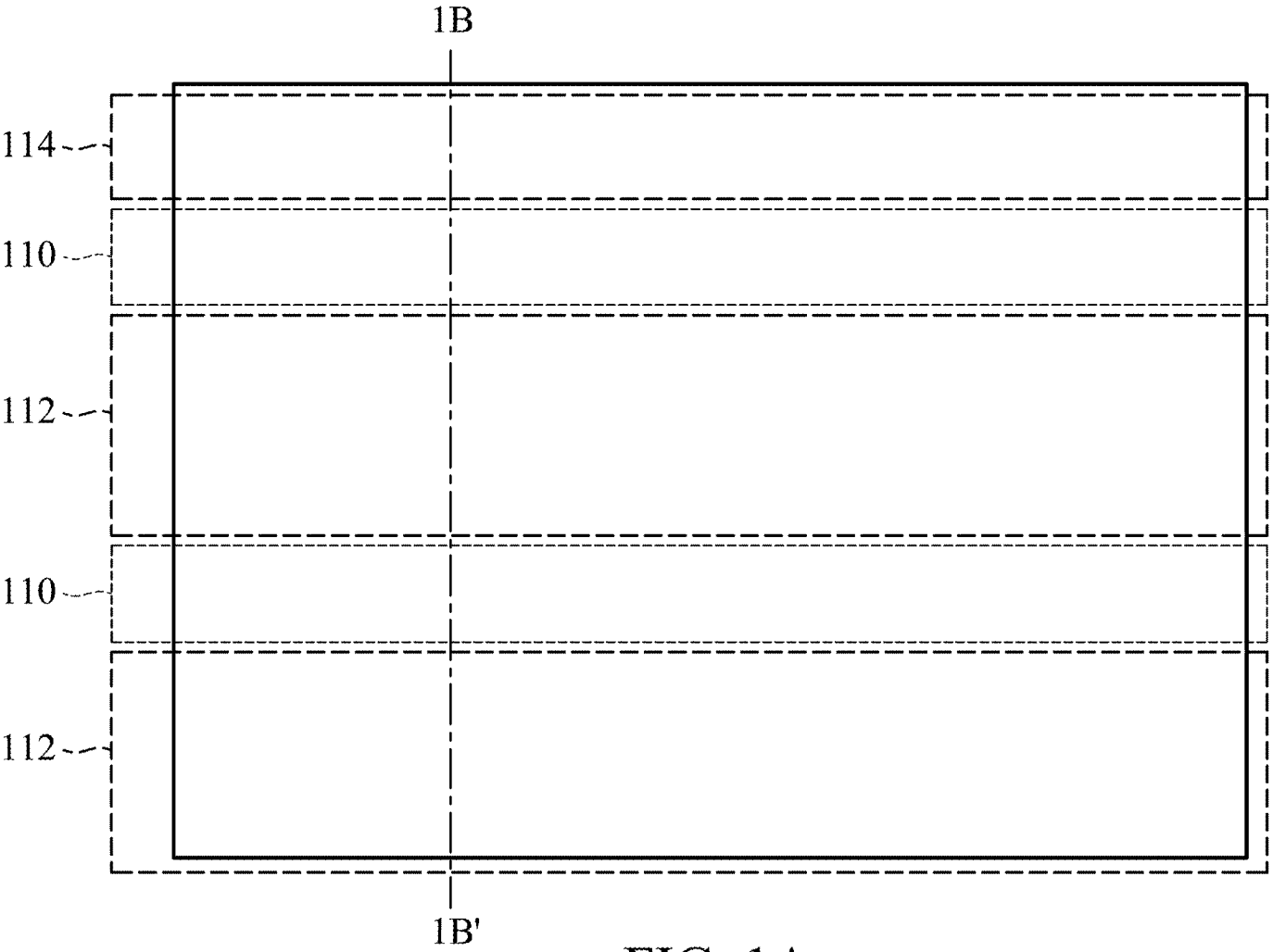
FIGS. 1A, 1B, 2A, 2B, 3A, 3B, 4A, 4B and 5 are cross-sectional views or top views of an example antenna structure at various manufacturing stages in accordance with some embodiments of the present disclosure.

The antenna structure of the present disclosure and the method for manufacturing this antenna structure are described in detail in the following description. In the following detailed description, for purposes of explanation, numerous specific details and embodiments are set forth in order to provide a thorough understanding of the present disclosure. The specific elements and configurations described in the following detailed description are set forth in order to clearly describe the present disclosure. It will be apparent, however, that the exemplary embodiments set forth herein are used merely for the purpose of illustration, and the inventive concept may be embodied in various forms without being limited to those exemplary embodiments. In addition, the drawings of different embodiments may use like and/or corresponding numerals to denote like and/or corresponding elements in order to clearly describe the present disclosure. However, the use of like and/or corresponding numerals in the drawings of different embodiments does not suggest any correlation between different embodiments. In addition, in this specification, expressions such as "first material layer disposed on/over a second material layer", may indicate the direct contact of the first material layer and the second material layer, or it may indicate a non-contact state with one or more intermediate layers between the first material layer and the second material layer. In the above situation, the first material layer may not be in direct contact with the second material layer.

It should be noted that the elements or devices in the drawings of the present disclosure may be present in any form or configuration known to those skilled in the art. In addition, the expression "a layer overlying another layer", "a layer is disposed above another layer", "a layer is disposed on another layer" and "a layer is disposed over another layer" may indicate that the layer is in direct contact with the other layer, or that the layer is not in direct contact with the other layer, there being one or more intermediate layers disposed between the layer and the other layer.

In addition, in this specification, relative expressions are used. For example, "lower", "bottom", "higher" or "top" are used to describe the position of one element relative to another. It should be appreciated that if a device is flipped upside down, an element that is "lower" will become an element that is "higher".

The terms "about" and "substantially" typically mean +/−20% of the stated value, more typically +/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. When there is no specific description, the stated value includes the meaning of "about" or "substantially".

It should be understood that, although the terms first, second, third etc. may be used herein to describe various elements, components, regions, layers, portions and/or sections, these elements, components, regions, layers, portions and/or sections should not be limited by these terms. These terms are only used to distinguish one element, component, region, layer, portion or section from another region, layer or section. Thus, a first element, component, region, layer, portion or section discussed below could be termed a second element, component, region, layer, portion or section without departing from the teachings of the present disclosure.

Unless defined otherwise, all technical and scientific terms used herein have the same meaning as commonly understood by one of ordinary skill in the art to which this disclosure belongs. It should be appreciated that, in each case, the term, which is defined in a commonly used dictionary, should be interpreted as having a meaning that conforms to the relative skills of the present disclosure and the background or the context of the present disclosure, and should not be interpreted in an idealized or overly formal manner unless so defined.

This description of the exemplary embodiments is intended to be read in connection with the accompanying drawings, which are to be considered part of the entire written description. The drawings are not drawn to scale. In addition, structures and devices are shown schematically in order to simplify the drawing.

In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The embodiment of the present disclosure utilizes an antenna branch and a grounding structure which are formed in one piece from the metal sheet to improve the yield and lower the cost.

Figure 1B:
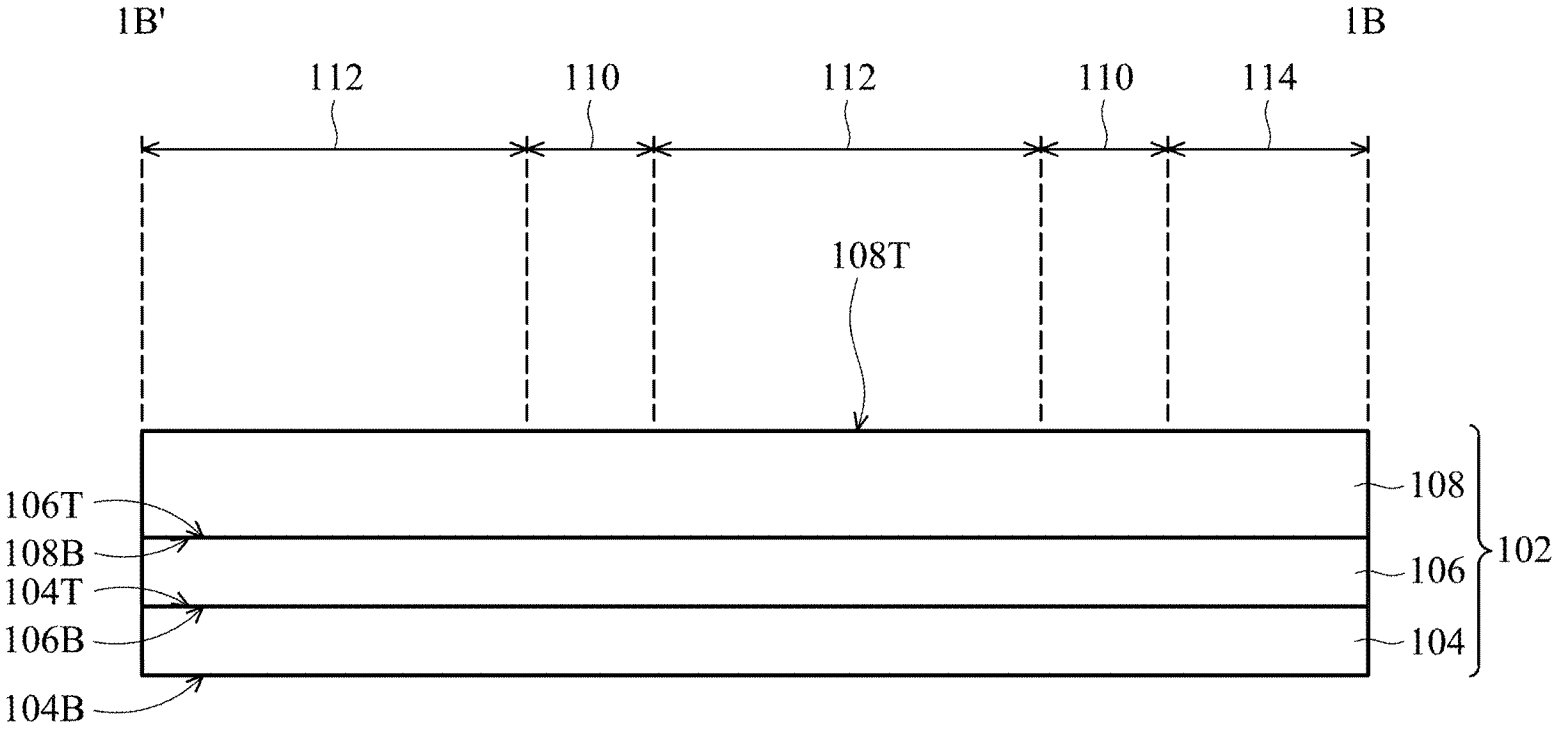

FIG. 1A is a top view of an antenna structure in one step of a manufacturing method of the antenna structure according to an embodiment of the present disclosure. FIG. 1B is a cross-sectional view along line 1B-1B' in FIG. 1A in accordance with some embodiments of the present disclosure. Referring to FIGS. 1A and 1B, a stack structure 102 is provided. The stack structure 102 sequentially includes a first release paper 104, a conductive glue 106 and a metal sheet 108.

The first release paper 104 includes a bottom surface 104B and a top surface 104T, and the bottom surface 104B and the top surface 104T are opposite sides of the first release paper 104. The conductive glue 106 includes a bottom surface 106B and a top surface 106T, and the bottom surface 106B and the top surface 106T are opposite sides of the conductive glue 106. The metal sheet 108 includes a bottom surface 108B and a top surface 108T, and the bottom surface 108B and the top surface 108T are opposite sides of the metal sheet 108. The conductive glue 106 is disposed over the top surface 104T of the first release paper 104, and the metal sheet 108 is disposed over the top surface 106T of the conductive glue 106.

In addition, as shown in FIG. 1A, the stack structure 102 includes an antenna branch-forming region 110 and a grounding structure-forming region 112, and may optionally include a dummy region 114. The antenna branch-forming region 110 is disposed between two grounding structure-forming regions 112, or disposed between the grounding structure-forming region 112 and the dummy region 114.

In some embodiments, the metal sheet 108 includes copper, aluminum, nickel, silver, palladium, platinum, gold, alloys thereof, or a combination thereof, or any other suitable conductive metal. For example, in some embodiments, the metal sheet 108 includes copper foil or aluminum foil.

In some embodiments, the conductive glue 106 may include polymer mixed with conductive particles. For example, in some embodiments, the conductive glue 106 is an acrylic adhesive mixed with conductive particles. The conductive particles may include copper, aluminum, nickel, silver, palladium, platinum, gold, alloys thereof, or a combination thereof, or any other suitable conductive particles.

In addition, in some embodiments, the stack structure 102 does not include any insulating layer disposed over the top surface 108T of the metal sheet 108.

Figure 2A:
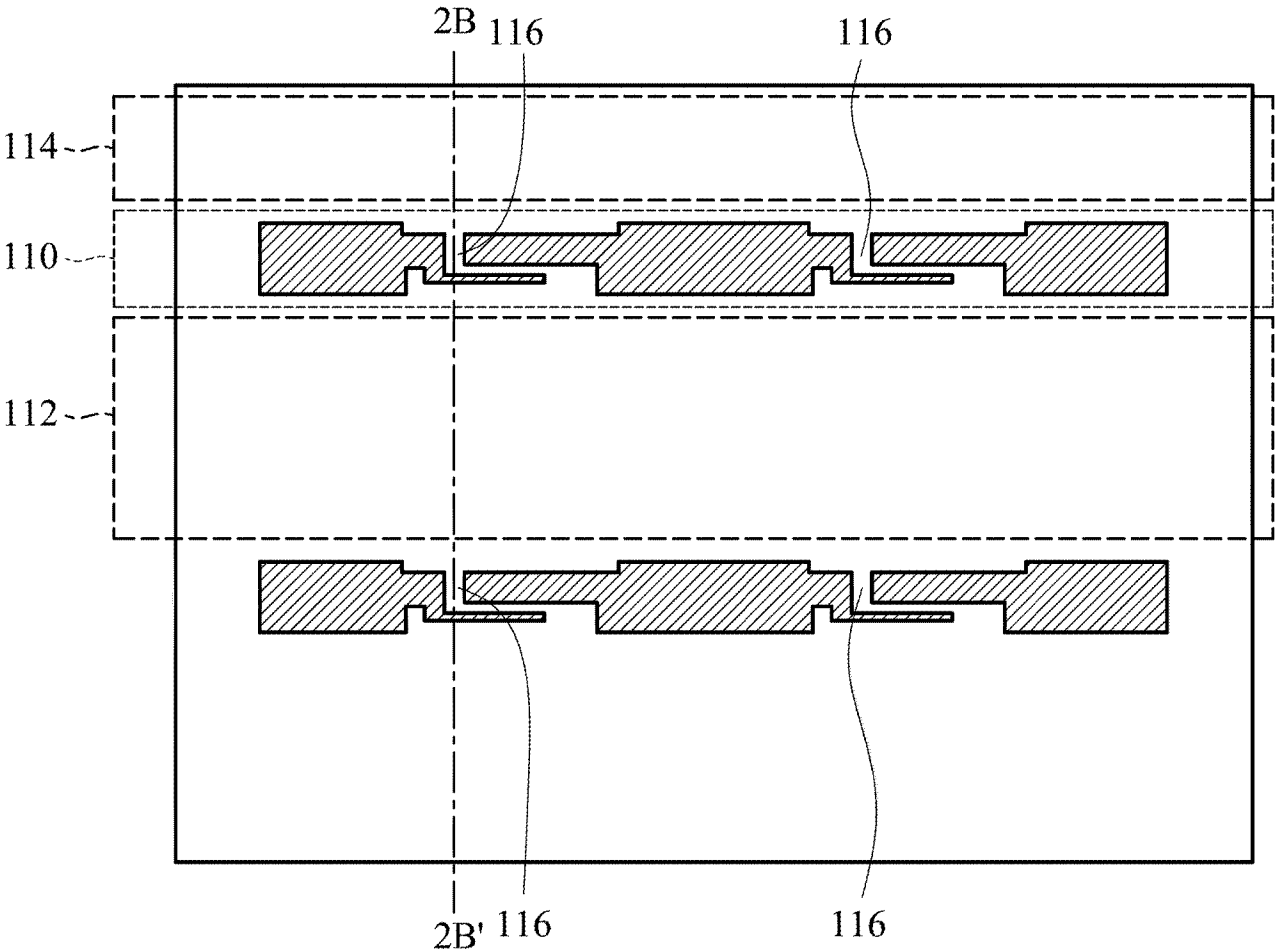
Figure 2B:
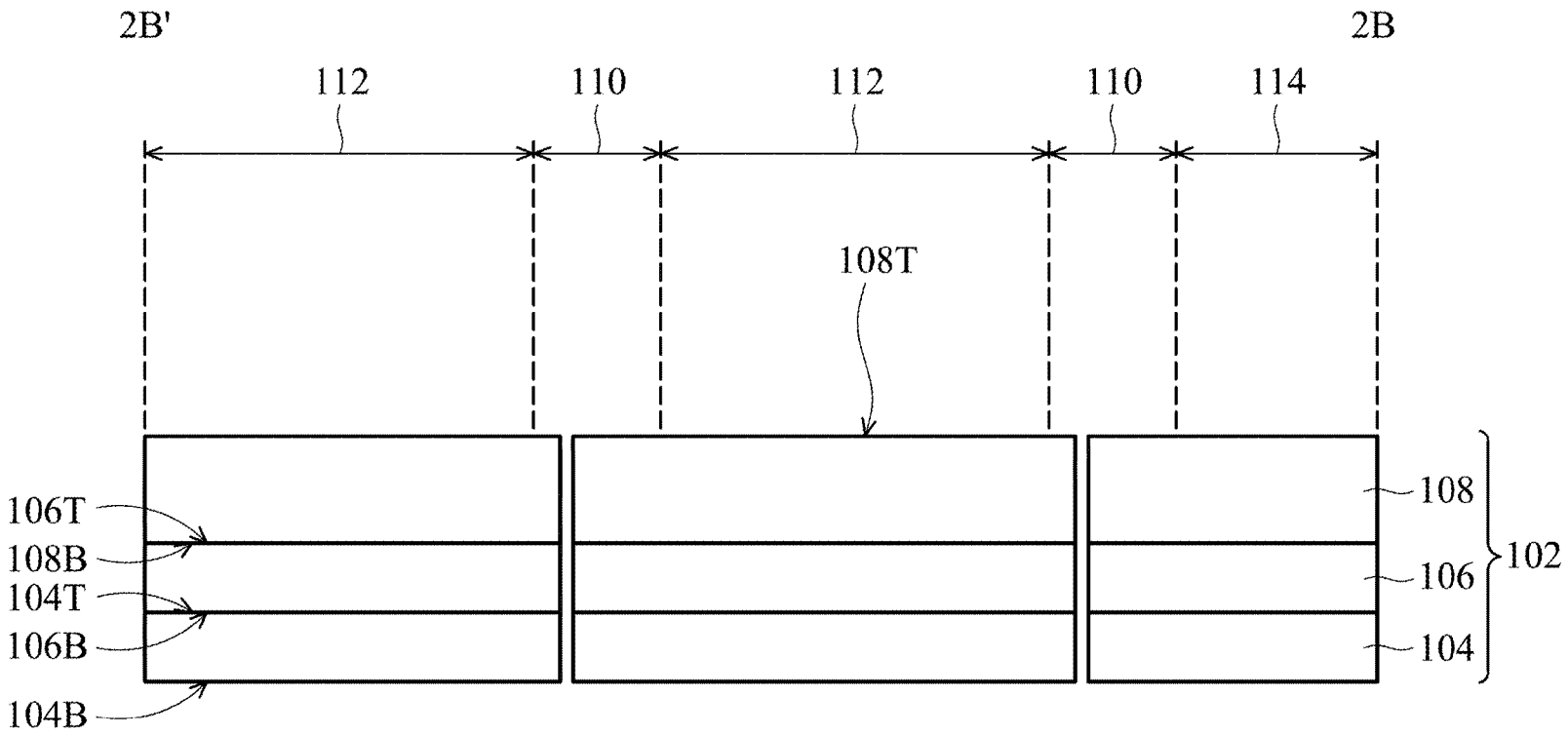

FIG. 2A is a top view of an antenna structure in one step of a manufacturing method of the antenna structure according to an embodiment of the present disclosure. FIG. 2B is a cross-sectional view along line 2B-2B' in FIG. 2A in accordance with some embodiments of the present disclosure. Referring to FIGS. 2A and 2B, a first cutting step is performed to cut the stack structure 102 in the antenna branch-forming region 110 to form an antenna branch 116.

It should be noted that the region removed in this cutting step is shown by slant lines.

In addition, it should be understood that after the first cutting step, the antenna branch 116 is still connected to the metal sheet 108, rather than being separated from the metal sheet 108. As shown in FIG. 2A, the antenna branch 116 is still connected to the metal sheet 108 through the dummy region 114 and grounding structure-forming regions 112 of the metal sheet 108 and the portion of the antenna branch-forming region 110 which is not removed. Alternatively, the antenna branch 116 may be connected to the metal sheet 108 through the two grounding structure-forming regions 112 disposed at the opposite side of the antenna branch 116 and the portion of the antenna branch-forming region 110 which is not removed.

In other words, the removed portion of the antenna branch-forming region 110 in FIG. 2B does not divide the metal sheet 108 into three separate pieces. The display of FIG. 2B is used for the reader to easily comprehend; however, in fact, the three pieces of the metal sheet 108 are partially connected to each other (please refer to FIG. 2A).

In addition, in order to clearly describe the embodiment of the present disclosure, FIG. 2A merely shows the antenna branch-forming region 110, the grounding structure-forming region 112, and the dummy region 114.

Figure 3A:
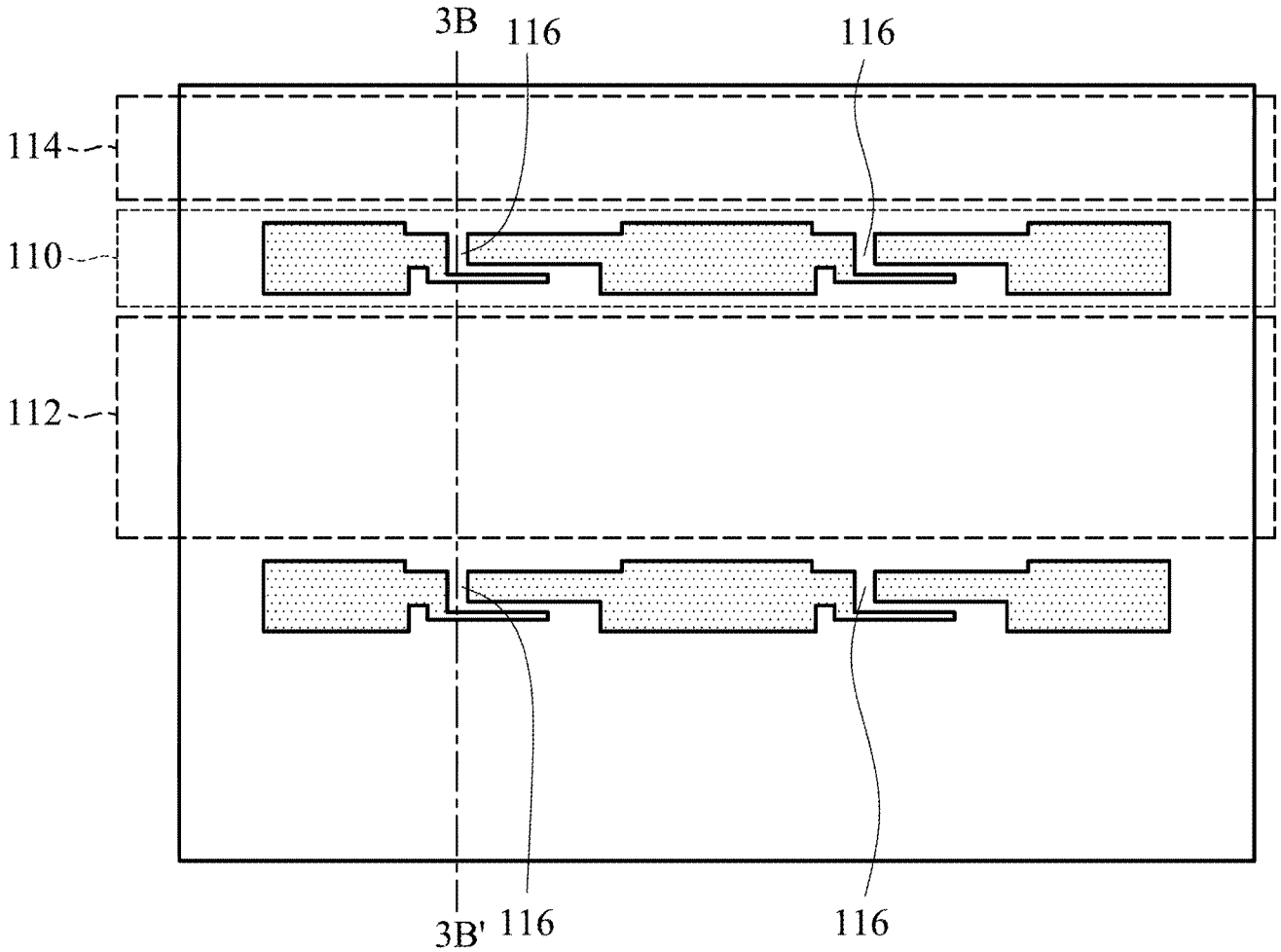
Figure 3B:
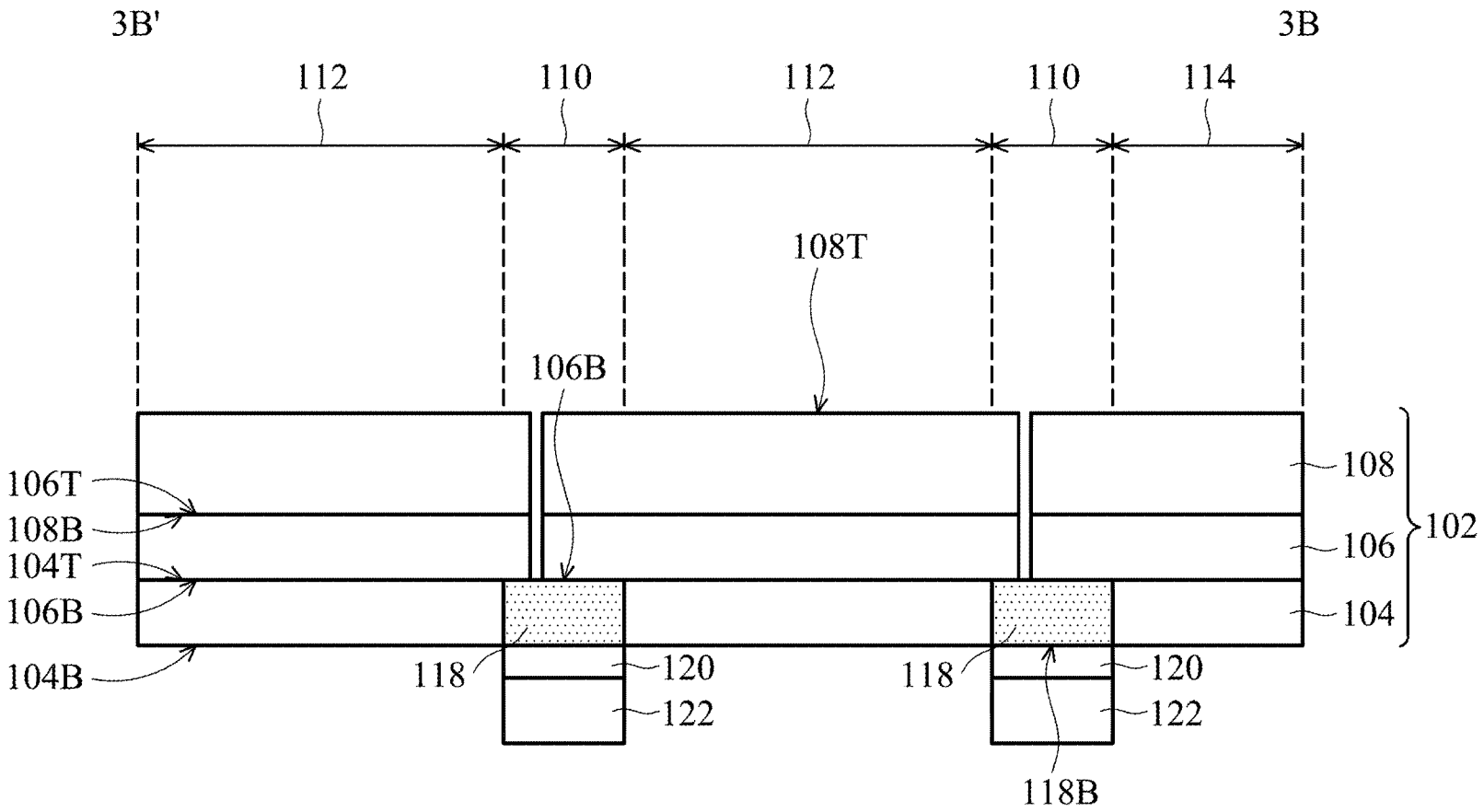

FIG. 3A is a top view of an antenna structure in one step of a manufacturing method of the antenna structure according to an embodiment of the present disclosure. FIG. 3B is a cross-sectional view along line 3B-3B' in FIG. 3A in accordance with some embodiments of the present disclosure. Referring to FIGS. 3A and 3B, the first release paper 104 in the antenna branch-forming region 110 is removed to expose a bottom surface 106B of the conductive glue 106 in the antenna branch-forming region 110. Subsequently, a supporting material 118 is attached onto the exposed bottom surface 106B of the conductive glue 106 in the antenna branch-forming region 110, as shown in FIG. 3B.

The first release paper 104 in the antenna branch-forming region 110 may be removed through the following steps. In some embodiments, a cutting step may be performed to cut the release paper in the antenna branch-forming region to form a cut line. Next, the first release paper 104 in the antenna branch-forming region 110 may be stripped off. Alternatively, in other embodiments, when the first cutting step is performed to cut the stack structure in the antenna branch-forming region, the cutting surface can be the surface of the release paper, namely the bottom surface 104B. Next, the first release paper 104 in the antenna branch-forming region 110 may be stripped off.

In some embodiments, the supporting material 118 may include hard insulating material. For example, in some embodiments, the supporting material 118 may include polyethylene terephthalate (PET), polyimide (PI), glass, or a combination thereof, or any other suitable material.

In addition, referring to FIG. 3B, an adhesive layer 120 and a second release paper 122 may be optionally disposed over the bottom surface 118B of the supporting material 118 sequentially. The adhesive layer 120 may include, but is not limited to, an acrylic adhesive. For example, the adhesive layer 120 may include, but is not limited to, an acrylic pressure-sensitive adhesive.

Figure 4A:
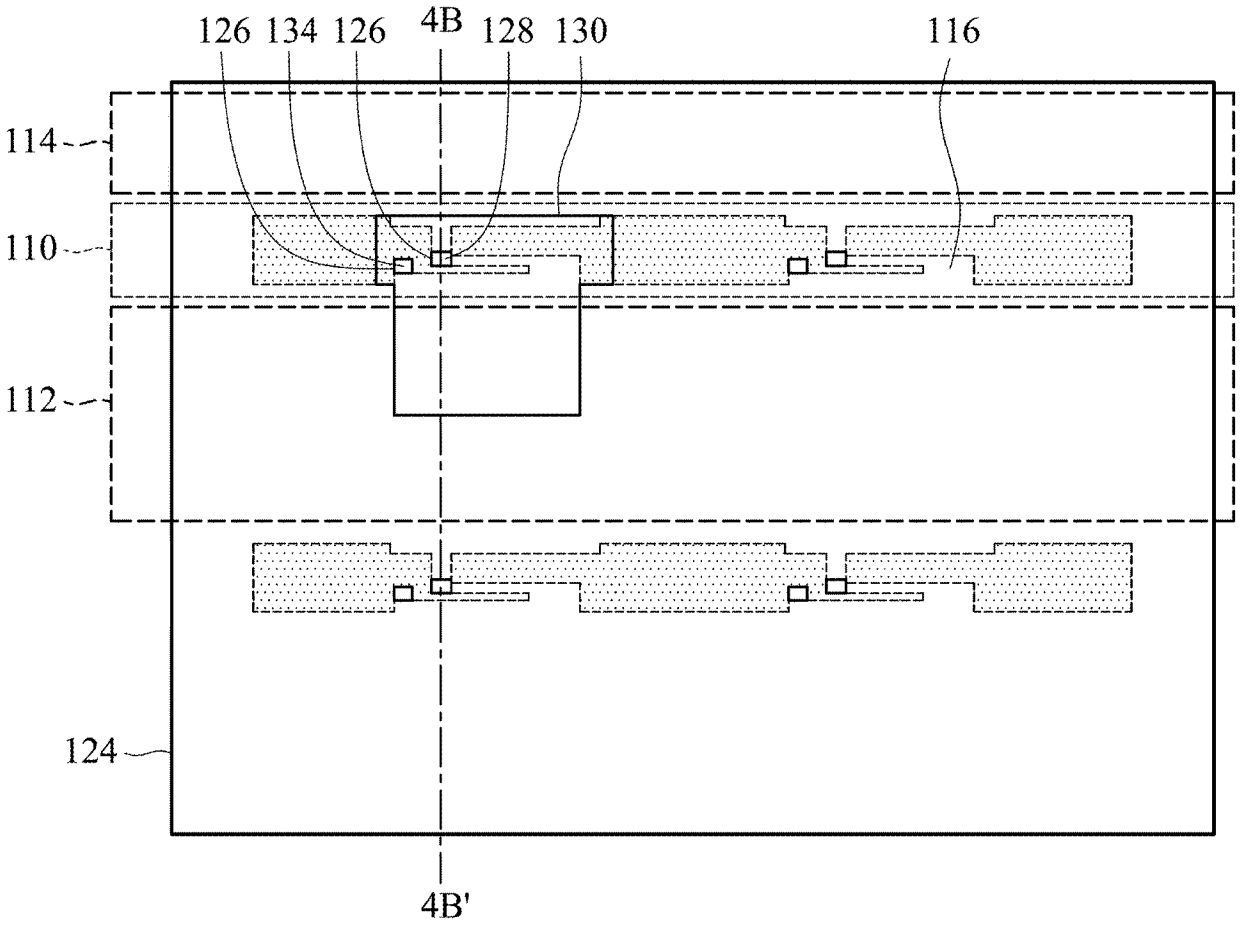
Figure 4B:
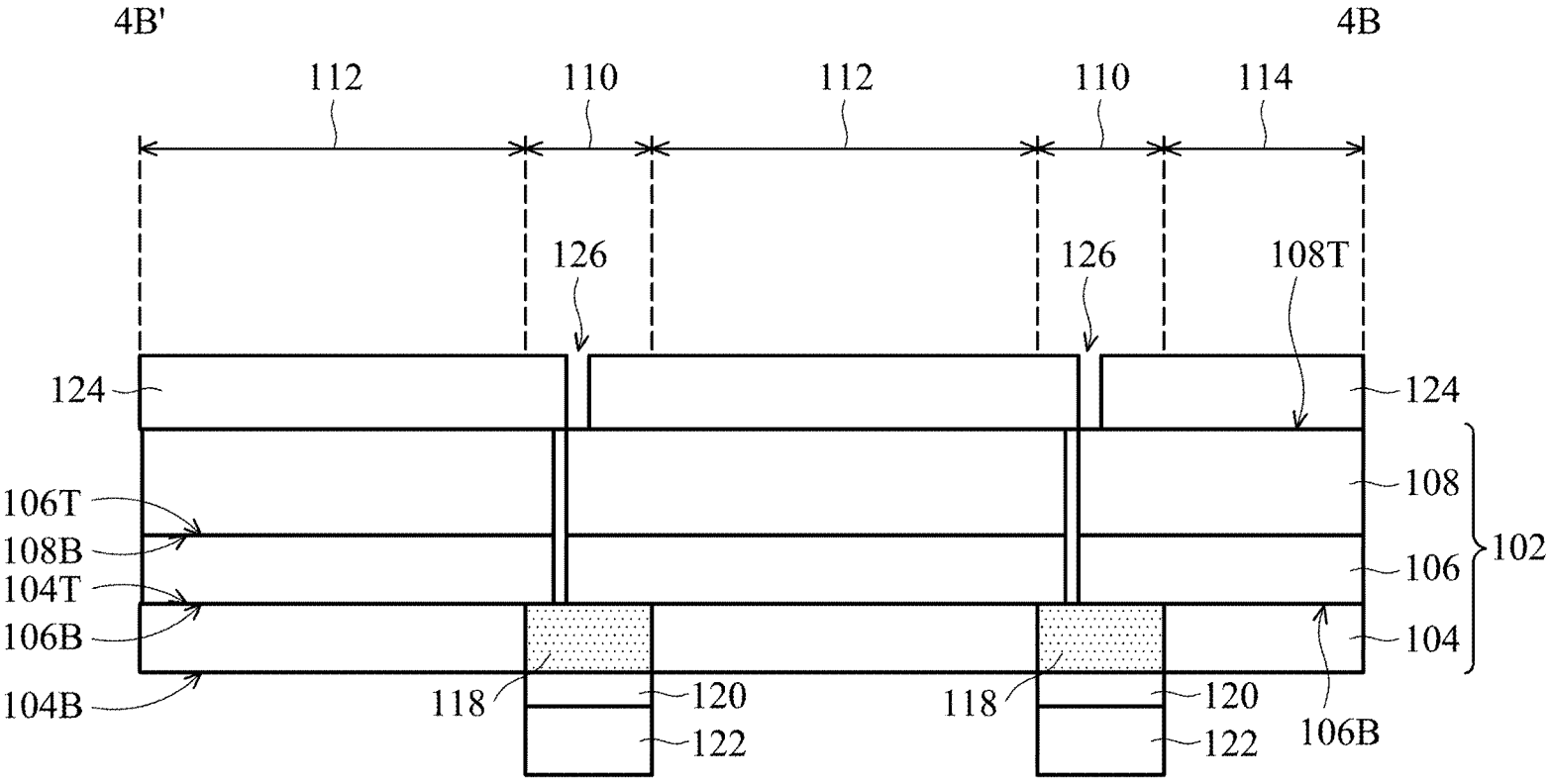

FIG. 4A is a top view of an antenna structure in one step of a manufacturing method of the antenna structure according to an embodiment of the present disclosure. FIG. 4B is a cross-sectional view along line 4B-4B' in FIG. 4A in accordance with some embodiments of the present disclosure. Referring to FIGS. 4A and 4B, an insulating layer 124 is disposed over a top surface 108T of the metal sheet 108. The insulating layer 124 includes at least two through holes 126 exposing a feed point 128 of the antenna branch 116 and a grounding point 134 of the subsequent grounding structure respectively. In other embodiments, the insulating layer 124 may only include through hole 126 exposing the feed point 128 of the antenna branch 116.

In addition, since the metal sheet 108 in FIG. 4A is covered by the insulating layer 124, the antenna branch 116 of the metal sheet 108 is shown by dashed line except the feed point 128 and grounding point 134 which are not covered by the insulating layer 124.

In addition, as shown in FIG. 4B, the through hole 126 penetrates through the insulating layer 124. However, it should be understood that the through holes 126 do not divide the insulating layer 124 into three separate pieces. The display of FIG. 4B is used for the reader to easily comprehend; however, in fact, the three pieces of the insulating layer 124 are partially connected to each other (please refer to FIG. 4A), and the size of the through hole 126 is much smaller than that of the insulating layer 124.

The insulating layer 124 may include, but is not limited to, polyethylene terephthalate (PET), polyimide (PI), solder resist ink, a combination thereof, or any other suitable insulating material. The solder resist ink may include, but is not limited to, epoxy resin, polyurethane (PU), a combination thereof, or any other suitable solder resist ink material. The insulating layer 124 may be disposed over the metal sheet 108 through attaching steps or through printing steps (printing the aforementioned solder resist ink).

In other words, in the aforementioned embodiment, the supporting material 118 is attached onto the exposed bottom surface 106B of the conductive glue 106 first, then the insulating layer 124 is disposed over a top surface 108T of the metal sheet 108. However, in other embodiments, the insulating layer may be disposed over a top surface of the metal sheet first, then the supporting material is attached onto the bottom surface of the conductive glue. Next, the first release paper 104 in the antenna branch-forming region 110 is removed to expose the bottom surface 106B of the conductive glue 106 in the antenna branch-forming region 110. Then the supporting material 118 is attached onto the exposed bottom surface 106B of the conductive glue 106 in the antenna branch-forming region 110.

Figure 5:
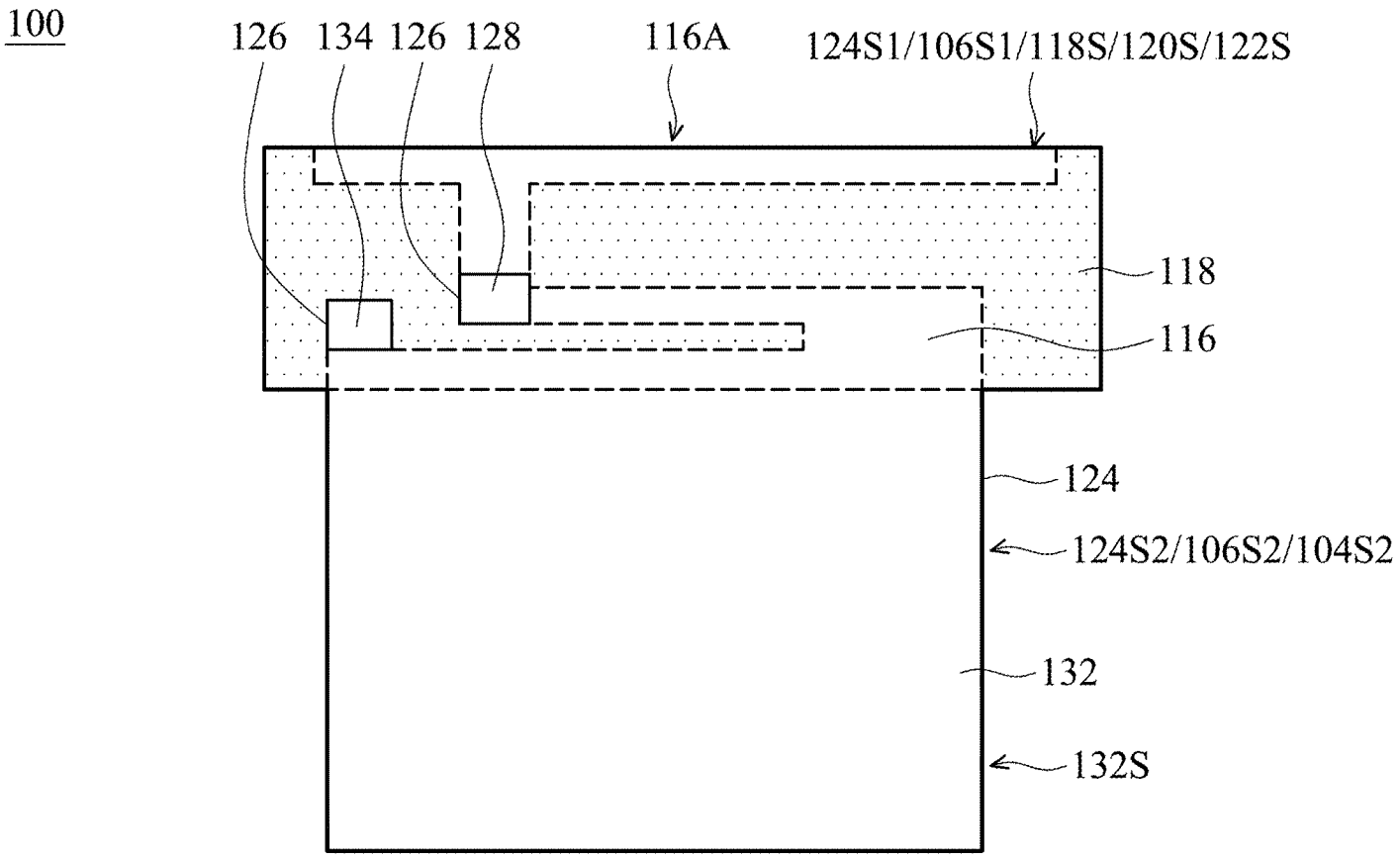

FIG. 5 is a top view of an antenna structure in one step of a manufacturing method of the antenna structure according to an embodiment of the present disclosure. Referring to FIGS. 4A and 5, a second cutting step is performed along the predetermined cutting region 130 to cut the insulating layer 124, the metal sheet 108, the conductive glue 106, the first release paper 104, the supporting material 118, the adhesive layer 120 and the second release paper 122 to form a grounding structure 132 in the grounding structure-forming region 112 and form the antenna structure 100. The antenna branch 116 and the grounding structure 132 of the antenna structure 100 are formed in one piece from the metal sheet 108. In other words, the antenna branch 116 and the grounding structure 132 of the antenna structure 100 are different portions of the same metal sheet. The antenna branch 116 is shown by dashed line in FIG. 5. In some embodiments, the antenna branch 116 is the portion of the cut metal sheet 108 corresponding to the supporting material 118.

Compared to the conventional method which forms the antenna branch on the substrate such as a printed circuit board or a flexible printed circuit board first, then electrically connects the antenna branch to another grounding structure, the embodiment of the present disclosure forms the antenna branch and the grounding structure from the same metal sheet. Therefore, the manufacturing method is simplified, the yield is improved and the cost is lowered.

In some embodiments, the second cutting step may include punching step. In addition, after the second cutting step, the top the edge 116A of the antenna branch 116 is aligned with the side 118S of the supporting material 118. In addition, after the second cutting step, the top the edge 116A of the antenna branch 116 is also aligned with the side 124S1 of the insulating layer 124, the side 106S1 of the conductive glue 106, the side 120S of the adhesive layer 120 and the side 122S of the second release paper 122.

In addition, after the second cutting step, the side 132S of the grounding structure 132 is aligned with another side 124S2 of the insulating layer 124, another side 106S2 of the conductive glue 106 and the side 104S2 of the first release paper 104.

In addition, in some embodiments, the insulating layer 124 completely covers the top surface 108T of the metal sheet 108 except the feed point 128 and the grounding point 134.

Still referring to FIGS. 4A-5, the antenna structure 100 of the embodiment of the present disclosure includes the metal sheet 108. The metal sheet 108 includes the antenna branch 116 and the grounding structure 132. The antenna branch 116 and the grounding structure 132 are formed in one piece from the metal sheet 108. In addition, the antenna structure 100 further includes the conductive due 106 disposed over the bottom surface 108B of the metal sheet 108 and the supporting material 118 disposed over a bottom surface 106B of the conductive glue 106. The supporting material 118 is disposed corresponding to the antenna branch 116 of the metal sheet 108. The antenna structure 100 further includes the insulating layer 124 disposed over the top surface 108T of the metal sheet 108, and the insulating layer 124 includes at least two through holes 126 exposing the feed point 128 of the antenna branch 116 and the grounding point 134 of the grounding structure 132 respectively. In other embodiments, the insulating layer 124 may only include through hole 126 exposing the feed point 128 of the antenna branch 116.

In addition, the antenna branch 116 may be configured as a main radiator of the antenna structure 100, and the total length of the antenna branch 116 may be equal to 0.5 or 0.25 wavelength of the corresponding frequency. The shape of the antenna branch 116 is not limited in the disclosure. For example, the antenna branch 116 may have a meandering shape, such as a loop shape, a U-shape, or an S-shape. It should be noted that, although FIG. 5 merely displays a single antenna branch 116, in other embodiments, the antenna structure may include multiple antenna branches 116 for operation in multiple frequency bands.

Figure 6A:
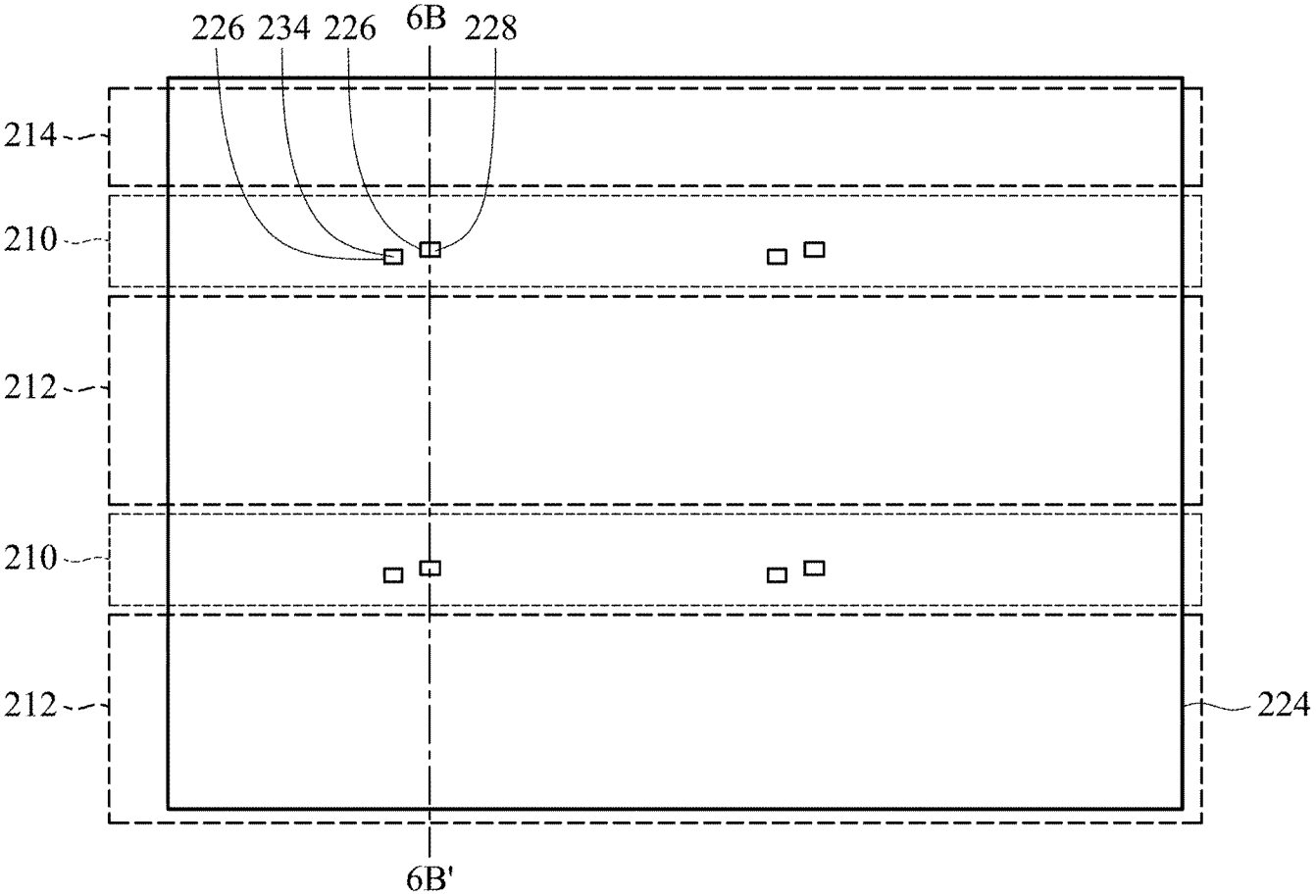
FIGS. 6A, 6B and 7 are cross-sectional views or top views of an example antenna structure at various manufacturing stages in accordance with another embodiment of the present disclosure.
Figure 6B:
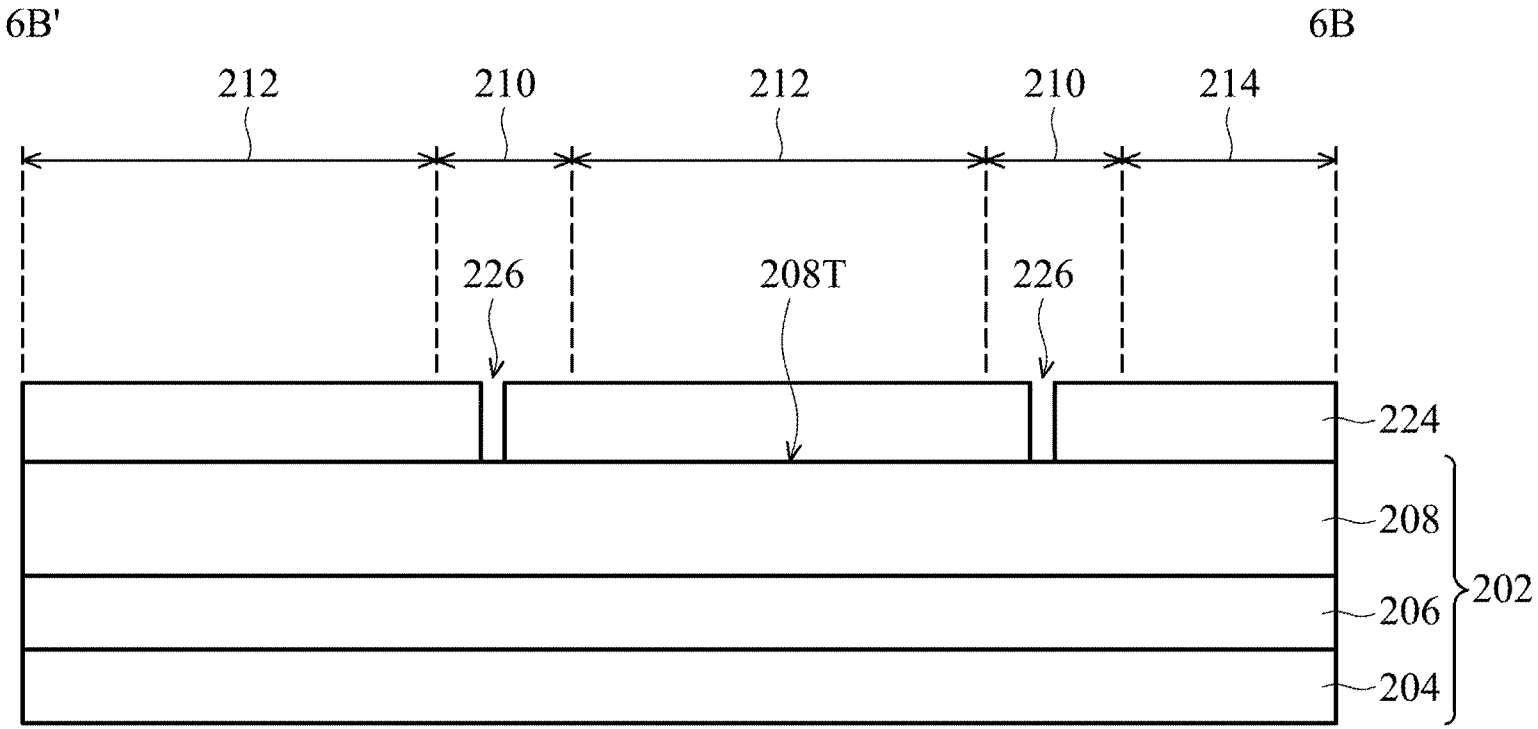
Figure 7:
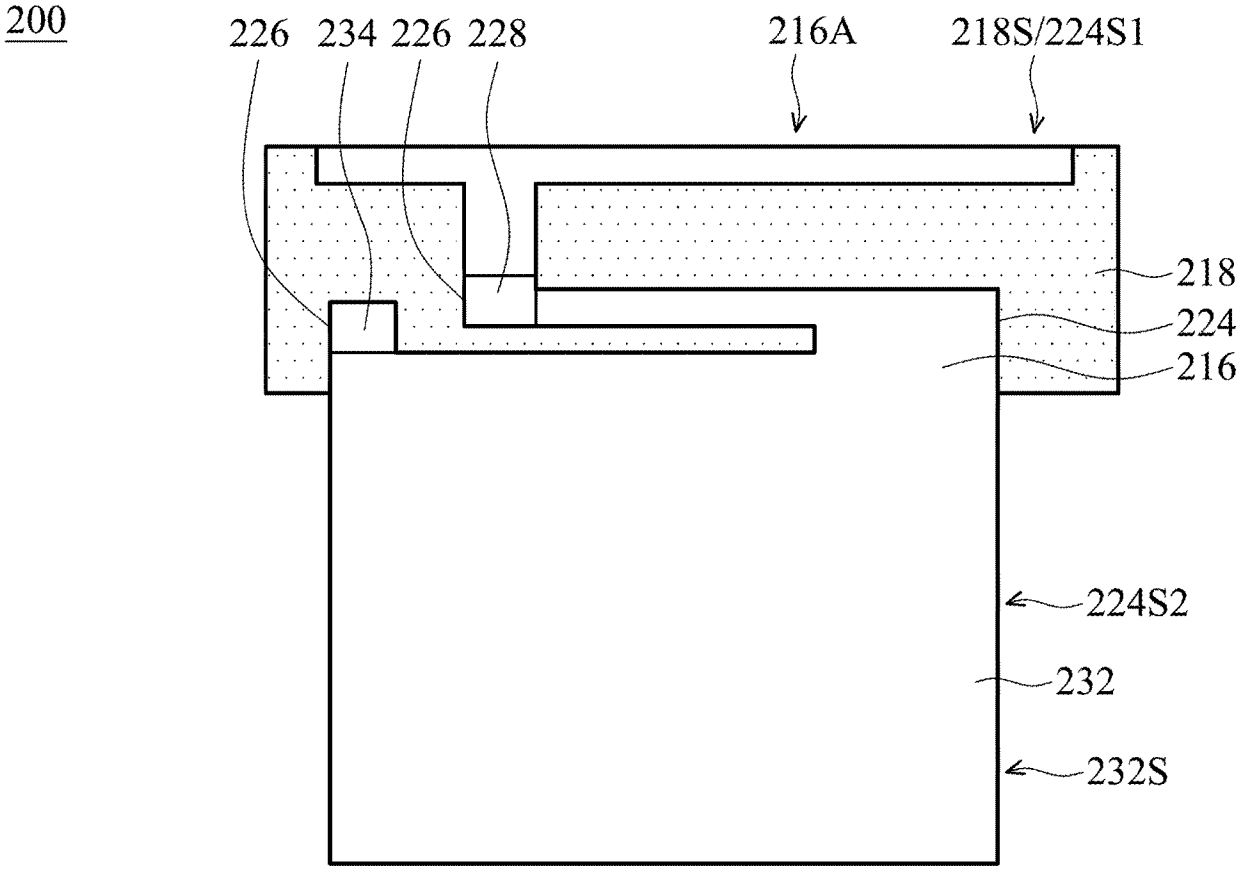

FIGS. 6A-7 are cross-sectional views or top views of an example antenna structure at various manufacturing stages in accordance with another embodiment of the present disclosure. Note that the same or similar elements or layers corresponding to those of the antenna structure are denoted by like reference numerals. The same or similar elements or layers denoted by like reference numerals have the same meaning and will not be repeated for the sake of brevity.

FIG. 6A is a top view of an antenna structure in one step of a manufacturing method of the antenna structure according to an embodiment of the present disclosure. FIG. 6B is a cross-sectional view along line 6B-6B' in FIG. 6A in accordance with some embodiments of the present disclosure. Referring to FIGS. 6A and 6B, the stack structure 202 sequentially includes a release paper 204, a conductive glue 206 and a metal sheet 208. In addition, the stack structure 202 includes an antenna branch-forming region 210 and a grounding structure-forming region 212, and may optionally include a dummy region 214.

The difference between the embodiments shown in FIGS. 6A-7 and 1A-5 is that, in the embodiment shown in FIGS. 6A-7, an insulating layer 224 is first disposed over a top surface 208T of the metal sheet 208. The insulating layer 224 includes at least two through holes 226 exposing a feed point 228 of the subsequent antenna branch and a grounding point 234 of the subsequent grounding structure respectively. In other embodiments, the insulating layer 224 may only include through hole 226 exposing the feed point 228 of the subsequent antenna branch.

Then, a first cutting step similar to that shown in FIGS. 2A-2B, a step for attaching the supporting material similar to that shown in FIGS. 3A-3B, and a second cutting step similar to that shown in FIGS. 4A and 5 are sequentially performed to form the antenna structure 200 shown in FIG. 7.

FIG. 7 is a top view of an antenna structure 200 in one step of a manufacturing method of the antenna structure 200 according to an embodiment of the present disclosure. Referring to FIG. 7, in some embodiments, after the second cutting step, the top the edge 216A of the antenna branch 216 is aligned with the side 218S of the supporting material 218. In addition, after the second cutting step, the top the edge 216A of the antenna branch 216 is also aligned with the side 224S1 of the insulating layer 224. In addition, after the second cutting step, the side 232S of the grounding structure 232 is aligned with another side 224S2 of the insulating layer 224.

Compared to the conventional method which forms the antenna branch on the substrate such as a printed circuit board or a flexible printed circuit board first, then electrically connects the antenna branch to another grounding structure, the embodiment of the present disclosure forms the antenna branch and the grounding structure from the same metal sheet. Therefore, the manufacturing method is simplified, the yield is improved and the cost is lowered.

In addition, as shown in FIG. 7, the insulating layer 224 only covers the antenna branch 216 except the feed point 228 and the grounding structure 232 except the grounding point 234.

In addition, although the width of the grounding structure 232 in FIG. 7 is smaller than that of the supporting material 218, the width of the grounding structure may be the same as that of the supporting material. Alternatively, the width of the grounding structure may be greater than that of the supporting material. Therefore, the inventive concept may be embodied in various forms without being limited to the exemplary embodiments shown in FIGS. 1A-7.

In addition, the antenna structures 100 or 200 may be adhered to a case by using an adhesion layer or the aforementioned adhesive layer. For example, the case may be a portion of an electronic device, and the electronic device may be a smart phone, a tablet computer, or a notebook computer.

Note that the above element sizes, element parameters, and element shapes are not limitations of the disclosure. An antenna engineer can adjust these settings or values according to different requirements. It is understood that the antenna structure and manufacturing method of the disclosure are not limited to the configurations of FIGS. 1A to 7. The disclosure may merely include any one or more features of any one or more embodiments of FIGS. 1A to 7. In other words, not all of the features shown in the figures should be implemented in the antenna structure and manufacturing method of the disclosure.

In summary, in the embodiment of the present disclosure, the antenna branch and the grounding structure are formed in one piece from the metal sheet to improve the yield and lower the cost. In addition, in the embodiment of the present disclosure, the first cutting step completely cuts through the stack structure which includes the release paper, the step for removing the unwanted metal sheet may be omitted. In addition, the manufacturing method of the antenna branch in the embodiment of the present disclosure needs no photolithography and etching step; therefore, the cost may be lowered.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An antenna structure, comprising:

a metal sheet comprising an antenna branch and a grounding structure, wherein the antenna branch and the grounding structure are formed in one piece from the metal sheet, wherein the metal sheet has a top surface and a bottom surface, and the top surface and the bottom surface are opposite each other;

a conductive glue disposed over the bottom surface of the metal sheet; and a supporting material disposed over a bottom surface of the conductive glue, wherein the supporting material is disposed corresponding to the antenna branch of the metal sheet.

2. The antenna structure as claimed in claim 1, wherein a top edge of the antenna branch is aligned with a side of the supporting material.

3. The antenna structure as claimed in claim 1, further comprising an insulating layer disposed over the top surface of the metal sheet, wherein the insulating layer comprises at least one through holes exposing a feed point of the antenna branch, wherein a side of the insulating layer is aligned with a top edge of the antenna branch, and a side of the grounding structure is aligned with another side of the insulating layer and a side of the conductive glue.

4. The antenna structure as claimed in claim 1, further comprising an insulating layer disposed over the top surface of the metal sheet, wherein the insulating layer comprises at least one through holes exposing a feed point of the antenna branch, wherein the insulating layer completely covers the top surface of the metal sheet except the feed point.

5. The antenna structure as claimed in claim 1, further comprising an insulating layer disposed over the top surface of the metal sheet, wherein the insulating layer comprises at least one through holes exposing a feed point of the antenna branch, wherein the insulating layer only covers the antenna branch and the grounding structure.

6. The antenna structure as claimed in claim 1, wherein the metal sheet comprises copper, aluminum, nickel, silver, palladium, platinum, gold, alloys thereof, or a combination thereof.

7. The antenna structure as claimed in claim 1, wherein the supporting material comprises polyethylene terephthalate (PET), polyimide (PI), glass, or a combination thereof.

8. A method for manufacturing an antenna structure, comprising:

providing a stack structure, wherein the stack structure comprises:

a release paper;

a conductive glue disposed over a top surface of the release paper; and a metal sheet disposed over a top surface of the conductive glue, wherein the stack structure comprises an antenna branch-forming region and a grounding structure-forming region;

performing a first cutting step to cut the metal sheet in the antenna branch-forming region to form an antenna branch;

removing the release paper in the antenna branch-forming region to expose a bottom surface of the conductive glue in the antenna branch-forming region, wherein the bottom surface and the top surface of the conductive glue are opposite each other;

attaching a supporting material onto the exposed bottom surface of the conductive glue in the antenna branch-forming region; and performing a second cutting step to cut the metal sheet, the conductive glue, the release paper and the supporting material to form a grounding structure in the grounding structure-forming region, wherein the antenna branch and the grounding structure are formed in one piece from the metal sheet.

9. The method for manufacturing the antenna structure as claimed in claim 8, after attaching the supporting material onto the exposed bottom surface of the conductive glue, further comprising disposing an insulating layer over a top surface of the metal sheet, wherein the insulating layer comprises at least one through holes exposing a feed point of the antenna branch.

10. The method for manufacturing the antenna structure as claimed in claim 8, further comprising disposing an insulating layer over a top surface of the metal sheet, wherein the insulating layer comprises at least one through holes exposing a feed point of the antenna branch, then attaching the supporting material onto the exposed bottom surface of the conductive glue.

11. The method for manufacturing the antenna structure as claimed in claim 8, wherein the first cutting step and the second cutting step comprise punching step.

12. The method for manufacturing the antenna structure as claimed in claim 8, wherein the first cutting step completely cuts through the stack structure.

13. The method for manufacturing the antenna structure as claimed in claim 8, wherein after the second cutting step, a top edge of the antenna branch is aligned with a side of the supporting material.

14. The method for manufacturing the antenna structure as claimed in claim 9, wherein after the second cutting step, a side of the grounding structure is aligned with a side of the insulating layer, a side of the conductive glue and a side of the release paper.

15. The method for manufacturing the antenna structure as claimed in claim 9, wherein the insulating layer completely covers the top surface of the metal sheet except the feed point and the grounding point.

16. The method for manufacturing the antenna structure as claimed in claim 8, further comprising disposing an insulating layer over a top surface of the metal sheet, then performing the first cutting step to cut the insulating layer and the metal sheet in the antenna branch-forming region, wherein the insulating layer comprises at least one through holes exposing a feed point of the antenna branch.

17. The method for manufacturing the antenna structure as claimed in claim 16, wherein after the first cutting step, in the antenna branch-forming region except regions corresponding to the through holes, a side of the insulating layer is aligned with a side of the antenna branch.

18. The method for manufacturing the antenna structure as claimed in claim 16, wherein the insulating layer only covers the antenna branch except the feed point.

* * * * *